US006421870B1

(12) United States Patent
Basham et al.

(10) Patent No.: US 6,421,870 B1
(45) Date of Patent: Jul. 23, 2002

(54) STACKED TOOLS FOR OVERTHROW SWEEPING

(75) Inventors: Michael T. Basham, Maple Grove; Joseph F. D'Costa, Minnetonka; Karl Hansen, Cottage Grove, all of MN (US)

(73) Assignee: Tennant Company, Minneapolis, MN (US)

( * ) Notice: Subject to any disclaimer, the term of this patent is extended or adjusted under 35 U.S.C. 154(b) by 0 days.

(21) Appl. No.: 09/498,184

(22) Filed: Feb. 4, 2000

(51) Int. Cl.[7] ..... E01H 1/04
(52) U.S. Cl. ..... 15/83; 15/340.4
(58) Field of Search ..... 15/82, 83, 86, 15/340.3, 340.4

(56) References Cited

U.S. PATENT DOCUMENTS

| | | | | |
|---|---|---|---|---|
| 1,328,521 A | | 1/1920 | Jemmison | |
| 1,514,289 A | | 11/1924 | Jemmison | |
| 1,585,768 A | | 5/1926 | Clayton et al. | |
| 1,610,119 A | | 12/1926 | Butler | |
| 1,861,681 A | | 6/1932 | Birdsall | |
| 2,448,328 A | | 8/1948 | Russell | |
| 2,964,204 A | | 12/1960 | Wilson | |
| 3,591,883 A | | 7/1971 | Armstrong | |
| 3,636,585 A | * | 1/1972 | Larsen | 15/340.3 |
| 3,668,730 A | | 6/1972 | Scharmann et al. | |
| 3,670,359 A | | 6/1972 | Gutbrod | |
| 3,805,310 A | | 4/1974 | Oberdank | |
| 3,823,435 A | | 7/1974 | Rhodes et al. | |
| 3,978,545 A | | 9/1976 | Morel | |
| 4,037,284 A | | 7/1977 | McDonald | |
| 4,042,994 A | | 8/1977 | Sassaman et al. | |
| 4,200,953 A | | 5/1980 | Overton | |
| 4,457,044 A | | 7/1984 | Erdman et al. | |
| 4,823,423 A | | 4/1989 | Schmid et al. | |
| 5,249,332 A | | 10/1993 | Wilkerson | |
| 5,295,277 A | | 3/1994 | Koenigs et al. | |
| 6,035,479 A | * | 3/2000 | Basham et al. | 15/83 |

FOREIGN PATENT DOCUMENTS

EP 482293 A * 6/1991

* cited by examiner

*Primary Examiner*—Terrence R. Till
(74) *Attorney, Agent, or Firm*—Fulbright & Jaworski L.L.P.

(57) ABSTRACT

A surface cleaning machine includes a frame, wheels for supporting the frame and a debris hopper positioned on the forward part of the frame. There is a cylindrical sweeping brush mounted on the frame for rotation about an axis transverse to machine movement. There is a drive on the frame for the sweeping brush with the sweeping brush being mounted behind the debris hopper and rotating in a direction to throw debris from a surface being cleaned forwardly toward the debris hopper. A cylindrical conveying brush, parallel to the sweeping brush, is mounted on the frame for rotation in the same direction as the sweeping brush. The same drive rotates both brushes. The conveying brush is positioned above the sweeping brush and located relative thereto to convey debris moved upwardly by the sweeping brush in an upward and forward direction toward the debris hopper. A scroll is mounted on the frame forward of both brushes and between the brushes and the debris hopper to direct the flow of debris from the brushes to the debris hopper.

27 Claims, 4 Drawing Sheets

40
50
48
64
38
44
60
42
54
58
46
66
62
72
56
52
70
12
36
34

STACKED TOOLS FOR OVERTHROW SWEEPING

THE FIELD OF THE INVENTION

The present invention relates to surface cleaning machines and more particularly to a combination of a sweeping brush and a conveying brush which move debris from a surface being cleaned in a highly efficient manner towards a debris hopper which is located forward of the brushes. There is an overthrow primary sweeping tool which functions in cooperation with a co-rotational stacked secondary tool or brush to move debris to a forward mounted hopper. The specific combination of co-rotational tools or brushes arranged to throw debris upwardly and forwardly to a debris hopper, in combination with a movable front flap and a sculptured sweeping zone formed by a forward scroll and a rear wall provide a highly efficient manner of sweeping all types of debris, including sand, gravel, and light litter to the debris hopper for collection.

SUMMARY OF THE INVENTION

The present invention relates to a surface cleaning machine and more specifically to such a machine which has an overthrow primary sweeping brush which cooperates with a co-rotational stacked secondary brush to move debris to a forwardly mounted debris hopper.

A primary purpose of the invention is to provide a sweeping machine as described which uses co-rotational stacked sweeping brushes to overthrow debris to a forwardly located debris hopper.

Another purpose of the invention is to provide a sweeping machine as described which has a movable front flap.

Another purpose of the invention is a debris collection machine as described in which there is a sweeping zone formed by a curved rear wall and a sculptured front wall or scroll which assists in efficiently moving debris from brush to brush and subsequently to the debris hopper.

Another purpose is to provide a sweeping machine which utilizes the unique combination of a sculptured front wall, co-rotational stacked brushes and a movable front flap to efficiently move debris which is swept toward a forwardly mounted debris hopper.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
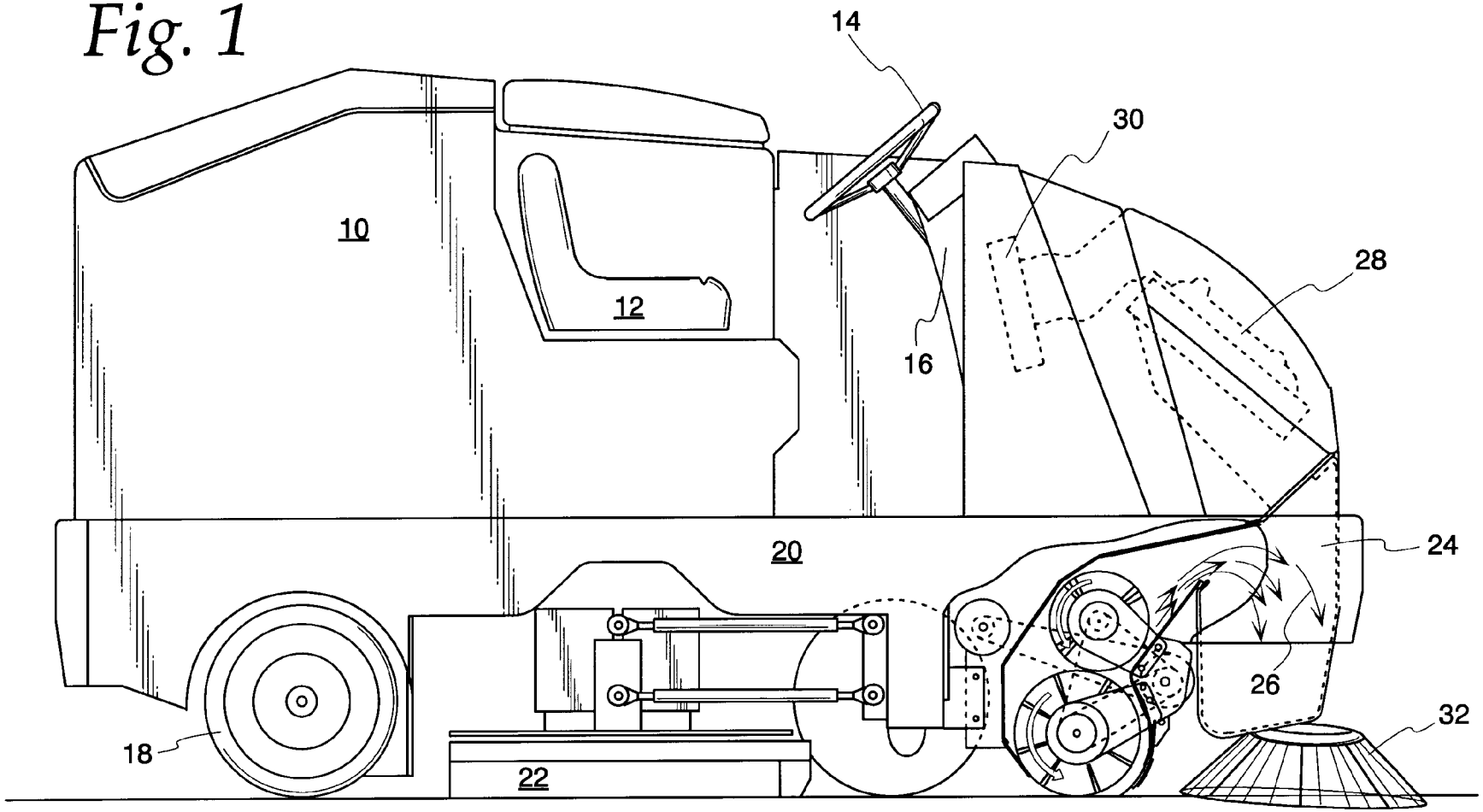
FIG. 1 is a side view, with portions broken away, of the sweeping machine of the present invention.

The stacked brush system of the present invention is designed as an efficient, high performance, sweeping system for all types of debris, including sand, gravel, and light litter. The components are selected for increased durability and assembled, relative to each other, to minimize system failure and clogging.

The stacked brush sweeping system of the present invention utilizes a rotary brush with a scroll and a movable front flap as the first stage of debris elevation. This primary configuration is referred to in the trade as an over the top system. The front flap can be raised off the ground so bulky debris can easily move into the sweeping chamber. A second tool or conveyance brush is stacked above the first stage or sweeping brush to lift debris higher and into a forward mounted hopper. A common front wall ties the sweeping and conveying systems together to guide debris through the system. The front wall is sculptured to efficiently move debris from brush to brush and to provide a sweeping scroll for the conveyor brush as well as for the sweeping brush.

Both brushes co-rotate, or rotate in the same direction, so debris is lifted up the curved front wall of the sweeping system to the front mounted hopper. This approach is far more efficient than the counter-rotating brushes used in the prior art. Counter-rotating brush systems tend to throw debris over the main brush to the conveyor brush above it. It has been determined that there is a greater percentage of debris re-circulation with counter-rotating brushes, thus debris carried over the top of the main brush is lost into the area behind the main brush. Counter-rotating brush systems also are more likely to jam in use because debris cannot be positively directed to the conveyance brush. There is an "inflection point" in a counter-rotating brush system where paper and other bulky material can become jammed. This is on the rear wall where debris transfers from one brush to another. The problem is that both brushes act on the debris in this region and try to move it in two different directions at the same time. Large debris can bridge the gap between brushes and become stuck, other debris hangs up on this first jam and the jam gets progressively worse in a counter-rotating system. The co-rotation system of the present invention does not have a pronounced "inflection point" so debris moves smoothly through the system, efficiency is higher and debris is less likely to become jammed.

The front and rear walls forming the sweeping and conveying duct extend about the stacked brushes and are used to smoothly guide debris. The front wall or front scroll provides a temporary buffer for debris so it can be re-swept by the conveyance brush. In this way the re-sweeping of debris by the sweeping brush is minimized, conveyance is improved because momentum of the debris is smoothly transferred from the rotating brushes to the debris and the debris trajectory is precisely controlled. Smooth flow of debris through the conveyance system minimizes impact and potential damage to components.

The main sweeping brush and the conveyance brush do not contact their respective scrolls and debris is entrained in void regions between the conveyance brush bristles so there is very little rubbing contact to wear the brushes or the walls defining the sweeping compartment. Because the conveyance brush tip speed matches the speed of debris traveling through the system, there is very little impact loading on brush components.

The main sweeping brush and the conveyance brush are mounted on a common pivot so both brushes move together as the main brush moves up and down. Such movement may be required so the main brush can follow the floor contour while sweeping or to adjust for wear during long term service. Moving the tools together on a common pivot, which is properly located, minimizes variances in the sweeping and conveyance processes by holding the brushes in a correct relationship to each other and to the walls defining the sweeping compartment, all of which provides a highly efficient sweeping system.

In FIG. 1, there is a floor cleaning machine indicated generally at 10 which may mount a driver seat 12, a steering wheel 14 and a control console 16. Wheels 18 support the machine frame 20. A scrubbing device is indicated at 22 any may include a squeegee, such as is shown in U.S. Pat. No. 5,940,928, owned by Tennant Company of Minneapolis, Minn., the assignee of the present application. The '928 patent is hereby incorporated by reference in this application.

There is a debris hopper 24 at the front of the machine 10 and debris will be thrown therein by the brush system to be described as illustrated by arrows 26. There is a dust collection filter 28 and a vacuum fan 30 which defines an air system for drawing dust from the sweeping area into the dust collection filter. The front of the machine 10 may have a pair of rotating side brushes 32.

Figure 2:
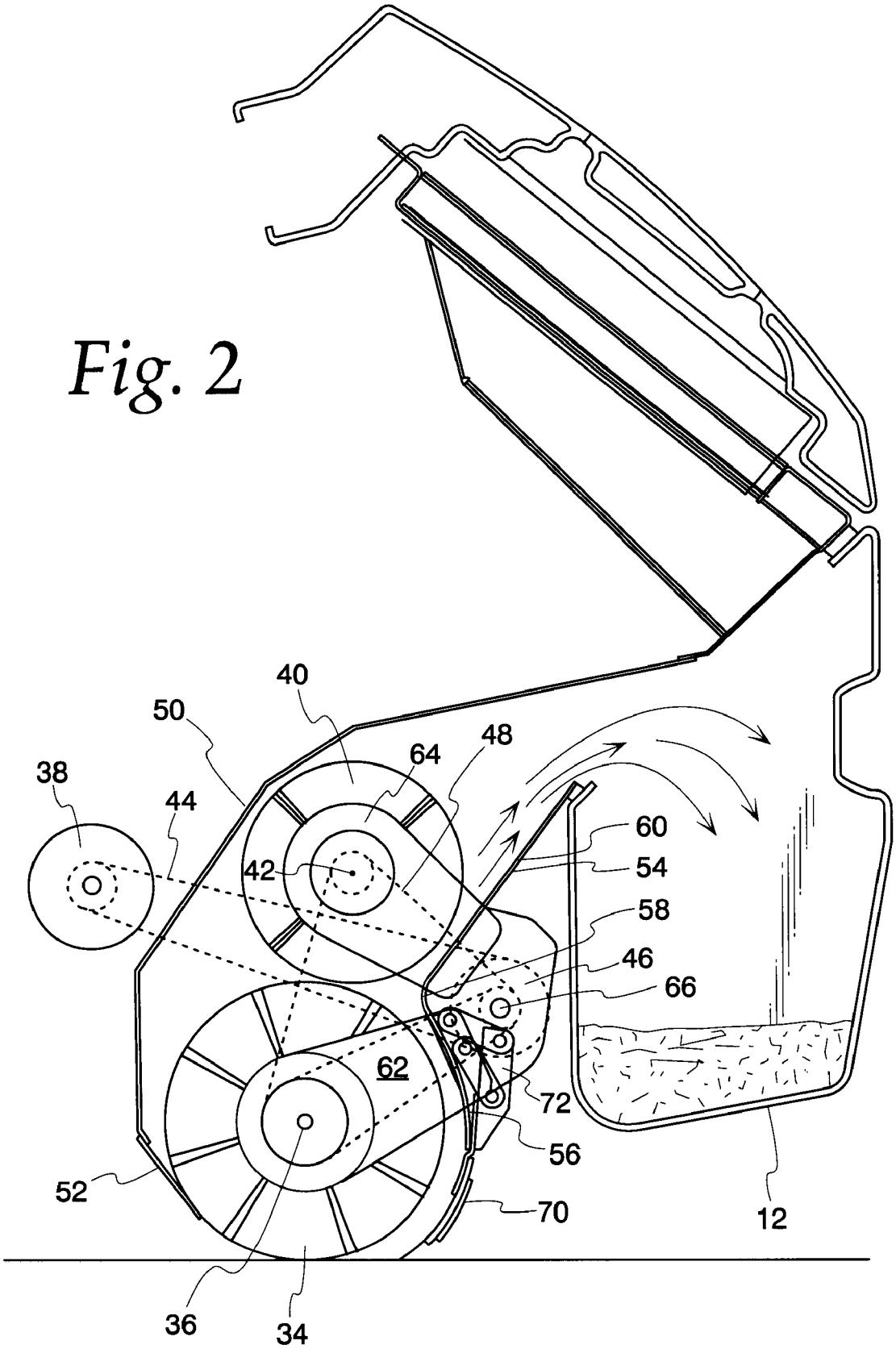
FIG. 2 is an enlarged side view of the sweeping brushes, the debris hopper and the walls that define the sweeping zone.

Focusing particularly on FIG. 2, there is a main sweeping brush 34 which rotates in a counter-clockwise direction about an axis 36. The brush 34 is driven by an electric motor 38. There is a conveyance brush or stacked brush 40 which also rotates in a counter-clockwise direction and turns about an axis 42. The drive motor 38 drives both brushes through a main drive belt 44 which turns a pulley system 46 which in turn drives a common belt 48 which wraps around the drive elements of both of the brushes 34 and 40.

There is a sweeping compartment which is defined by a curved rear wall 50 which is contoured to be closely adjacent, but not in contact with either of the sweeping or conveyance brushes but defines the rear wall of the path for debris moving from the area directly adjacent brush 34 into the debris hopper 24. At the bottom of the rear wall 50 there may be a re-circulation flap 52 which fits closely adjacent the rear of the sweeping brush 34 as is common in the art.

The front wall of the sweeping compartment is defined by a forward scroll 54 which has a lower curved portion 56 which generally follows the outline of the sweeping brush 34 and then has a bend 58 joining the lower portion 56 with an upper forwardly slanting wall portion 60. Wall portion 60 terminates in contact with the debris hopper 24. The scroll 54 is sculptured or contoured to assist in directing debris from the co-rotational sweeping brushes 34 and 40 into the debris hopper as shown by the arrows 26.

Figure 4:
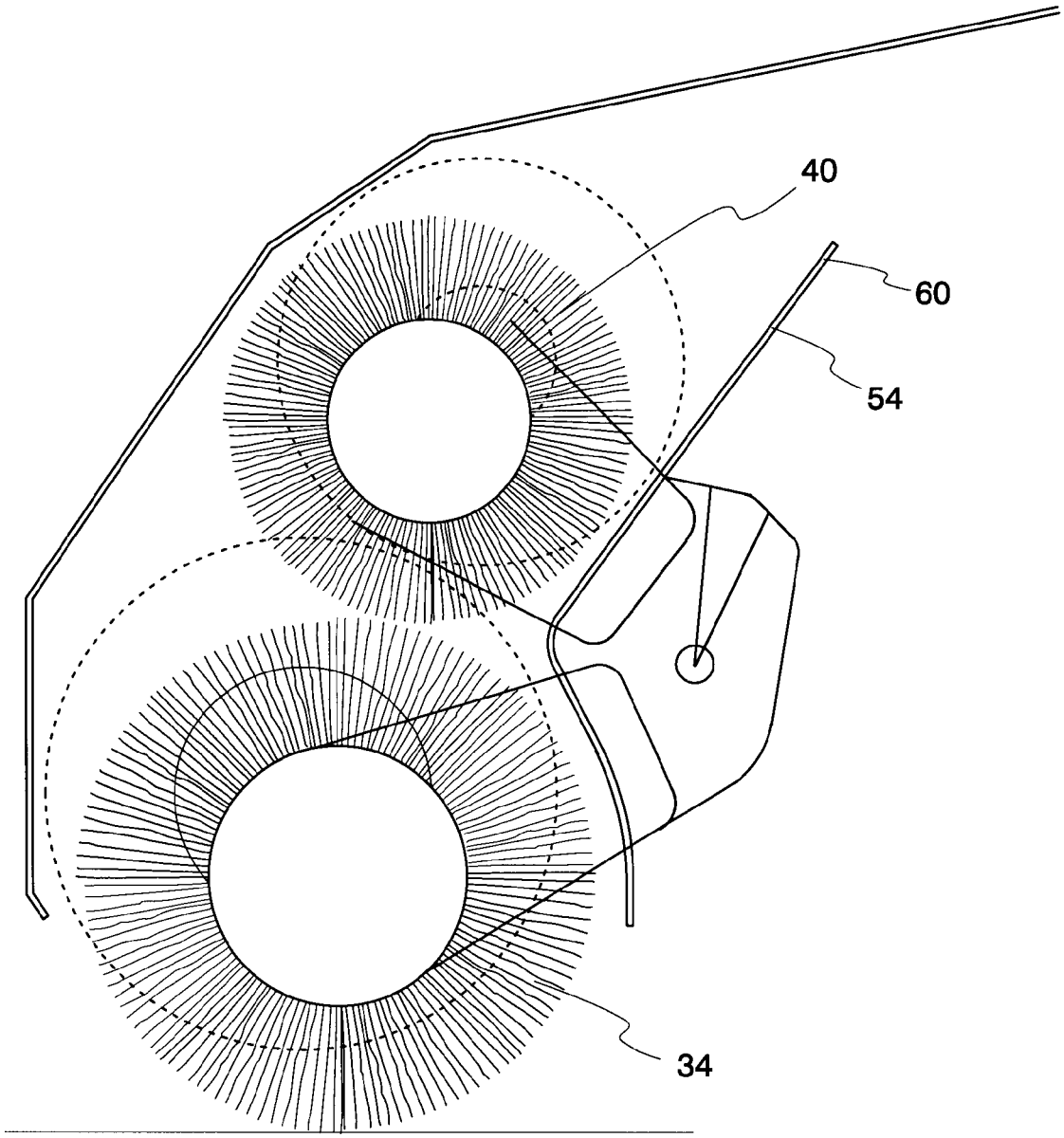
FIG. 4 is a diagrammatic showing of raised and lowered positions of the concurrently movable sweeping brushes.

Brush 34 is supported on its opposite ends by arms 62. Similarly, conveyance brush 40 is mounted on arms 64. Both arms 62 and arms 64 are pivoted about a common point 66. Thus, up and down movement of the common pivot point 66 will raise and lower the sweeping brush and the conveyance brush simultaneously and will maintain a fixed relationship between the brushes as shown in the drawings. FIG. 4 indicates a normal working position for the brushes and an up position for the brushes, and in each instance it is clear that the spacial relationship between the brushes remains the same. The brushes may be lowered to accommodate brush wear and may be raised for transport.

Figure 3:
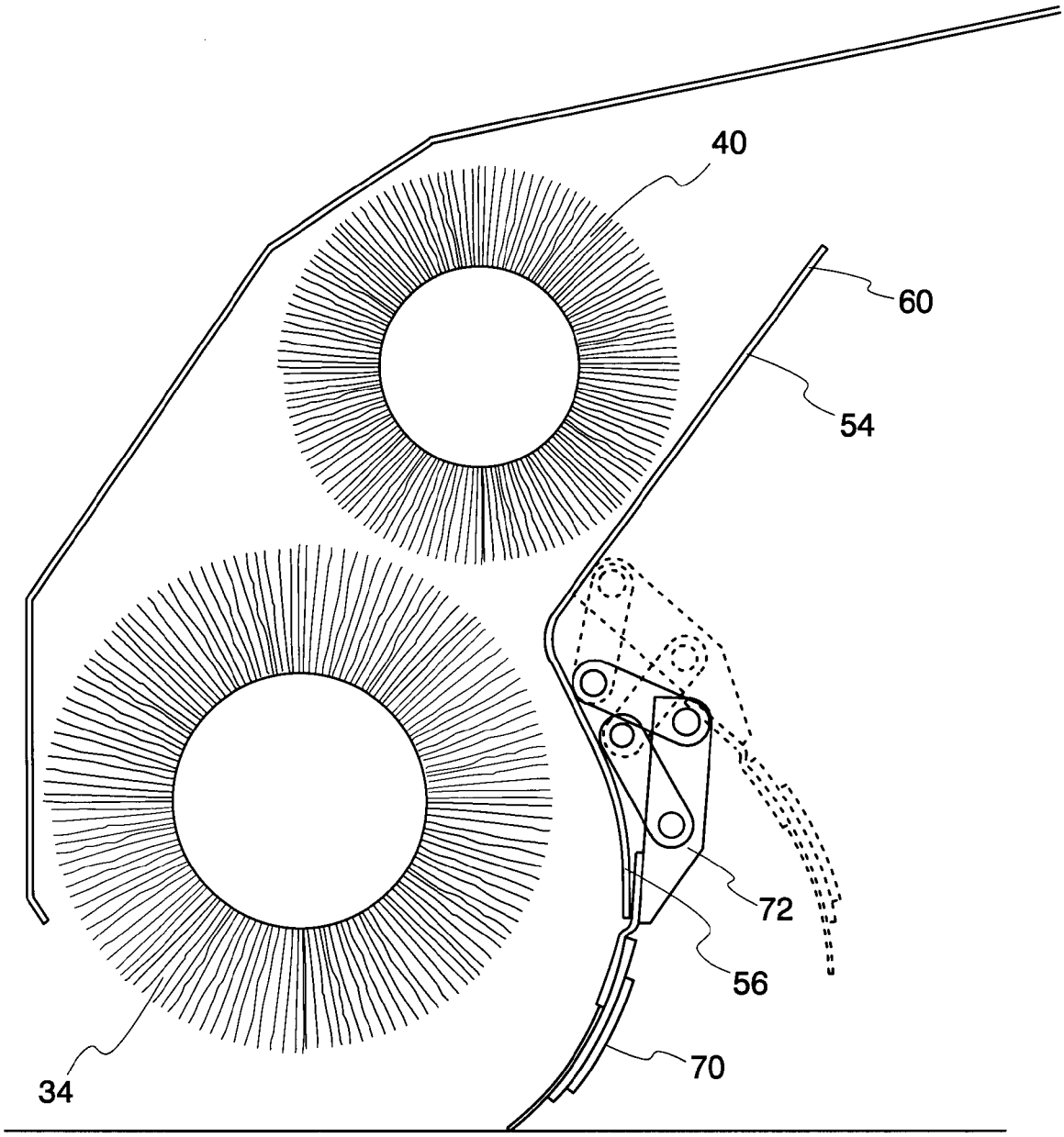
FIG. 3 is a diagrammatic showing of the brushes and raised and lowered positions of the front flap.

There is a front flap 70 which is positioned adjacent the bottom of the scroll portion 56 and which will be raised and lowered by a lever system indicated at 72 and shown in more detail in U.S. Pat. No. 5,991,953, herein incorporated by reference, and which is owned by the Tennant Company of Minneapolis, Minn. The 953' patent shows a mechanism whereby the front flap may be raised or lowered in an environment similar to that disclosed herein. The flap 70 is raised and lowered by the operator for easier entry of bulky debris into the sweeping chamber defined by the scroll and the rear wall. FIG. 3 shows a lowered position and a raised position of the front flap and the consequent movement of the linkage 72. The operator of the machine controls both the raising and lowering of the front flap and the raising and the lowering of the concurrently moving sweeping brush and conveyance brush.

In normal operation, the front flap, which has a lower flexible portion made of a resilient material will glide along the floor in front of the main brush. The suspension or linkage 72 allows the flap assembly to move up and over obstructions to prevent damage. Debris which passes underneath the flap and enters the sweeping chamber defined by the front scroll and the rear wall will be moved by the counter-clockwise rotating brush 34 up towards the counter-clockwise rotating conveyance brush 40. The transfer will be smooth and the contoured scroll 54 will assist in slowly moving the debris from one brush to the other and then moving the debris up along the portion 60 of the scroll and into the forwardly located debris hopper 24. The sweeping chamber is defined by the two walls and the rear wall 50 closely follows the contour of the stacked brushes. The re-circulation flap at the bottom of the rear wall serves to recycle debris that may be thrown over the top of the main brush instead of being conveyed into the hopper by the conveyance brush. Such recycled debris will then be fed back to the main brush for sweeping in the described manner.

Whereas the preferred form of the invention has been shown and described herein, it should be realized that there may be many modifications, substitutions and alterations thereto.

The embodiments of the invention in which an exclusive property or privilege is claimed are defined as follows:

1. A surface cleaning machine including a frame, wheels for supporting the frame, a debris hopper on a forward part of the frame, a cylindrical sweeping brush mounted on the frame for rotation about an axis that is transverse to machine movement when cleaning a surface, a drive for said sweeping brush, said sweeping brush being mounted behind the debris hopper on the frame and rotating in a direction to throw debris from a surface being swept forwardly toward the debris hopper, a cylindrical conveying brush mounted on the frame for rotation about an axis that is parallel to the sweeping brush, said sweeping brush drive driving said conveying brush in the same rotary direction as said sweeping brush, said conveying brush being positioned above said sweeping brush and being located relative thereto to convey debris moved upwardly by the sweeping brush in an upward and forward direction toward the debris hopper, and a scroll mounted on the frame forwardly of the sweeping brush and conveying brush and between said brushes and said debris hopper to direct the flow of debris from said brushes to said debris hopper, both of said sweeping brush and conveying brush being movably mounted on said frame for movement toward said scroll to accommodate wear of the brushes.

2. The surface cleaning machine of claim 1 wherein said brushes are mounted on said frame for concurrent movement toward or away from a surface to be swept.

3. The surface cleaning machine of claim 2 wherein said brushes are pivotally mounted on said frame for concurrent movement.

4. The surface cleaning machine of claim 3 wherein said sweeping brush is mounted on said frame by a pair of arms, one on each end of said sweeping brush, said conveying brush being mounted on said frame by a pair of arms, one at each end of said conveying brush, said sweeping brush arms and said conveying brush arms being pivotally attached to said frame at a common pivot point thereon.

5. The surface cleaning machine of claim 1 wherein said brush drive includes a motor and drive belt means connecting said motor with both said sweeping brush and said conveying brush.

6. The surface cleaning machine of claim 1 wherein said scroll has a first lower portion spaced from and curved about said sweeping brush and a second upper portion which extends from a location between said brushes forwardly toward and in contact with said debris hopper.

7. The surface cleaning machine of claim 6 wherein said scroll lower portion has a curvature generally matching that of the circumference of said sweeping brush.

8. The surface cleaning machine of claim 6 further including a rear wall mounted on said frame behind both said sweeping brush and said conveying brush which rear wall, together with said scroll, forms a sweeping compartment.

9. The surface cleaning machine of claim 8 further including a re-circulation flap positioned at the lower end of said rear wall and generally adjacent a rear surface of said sweeping brush.

10. The surface cleaning machine of claim 1 wherein both said conveying brush and sweeping brush are rotated in a counter-clockwise direction with said sweeping brush moving debris upwardly toward said conveying brush and said conveying brush moving debris from said sweeping brush into said debris hopper.

11. The surface cleaning machine of claim 1 further including a lower movable front flap assembly positioned on said frame in front of said sweeping brush.

12. The surface cleaning machine of claim 11 wherein said front flap assembly includes a lower flexible portion and wherein said front flap assembly is movable relative to said scroll.

13. A surface cleaning machine comprising;

a mobile frame;

a debris hopper carried upon the surface by the frame;

a cylindrical sweeping brush carried by the frame, said sweeping brush rotating in a direction to throw debris from a surface being swept toward the debris hopper;

a cylindrical conveying brush carried by the frame for rotation about an axis that is parallel to the sweeping brush, said conveying brush being positioned above said sweeping brush and being located relative thereto to convey debris moved upwardly by the sweeping brush in an upward direction toward the debris hopper; and a scroll carried by the frame forwardly of the sweeping brush and conveying brush, said scroll to direct the flow of debris from said brushes to said debris hopper, both of said sweeping brush and said conveying brush being selectively movable toward said scroll to accommodate wear of the brushes.

14. A surface cleaning machine of claim 13, wherein the sweeping brush rotates about an axis that is transverse to machine movement when cleaning a surface.

15. A surface cleaning machine of claim 13, wherein the scroll includes a lower curved portion generally proximate to the sweeping brush and an upper forwardly slanting wall portion.

16. A surface cleaning machine of claim 15, wherein said scroll lower portion has a curvature generally matching that of the circumference of said sweeping brush.

17. A surface cleaning machine of claim 13, wherein the debris hopper is carried upon a forward portion of the frame.

18. A surface cleaning machine of claim 13, wherein the brushes are carried on the frame for concurrent movement toward or away from a surface to be swept.

19. A surface cleaning machine of claim 18, wherein the brushes are pivotally mounted on the frame for concurrent movement.

20. A surface cleaning machine of claim 13, further including a rear wall mounted on the frame behind both the sweeping brush and the conveying brush which rear wall, together with the scroll, forms a sweeping compartment.

21. A surface cleaning machine of claim 20, further including a re-circulation flap positioned at the lower end of the rear wall and generally adjacent a rear surface of the sweeping brush.

22. A surface cleaning machine of claim 13, further including a lower movable front flap assembly positioned on the frame in front of the sweeping brush.

23. A surface cleaning machine comprising:

a mobile frame;

a debris hopper carried by the frame;

a cylindrical sweeping brush carried on the fame, said sweeping brush rotating in a direction to throw debris from a surface being swept toward the debris hopper;

a cylindrical conveying brush carried on the frame for rotation about an axis that is parallel to the sweeping brush, said conveying brush being positioned above said sweeping brush and being located relative thereto to convey debris moved upwardly by the sweeping brush in an upward direction toward the debris hopper;

a scroll carried on the frame forwardly of the sweeping brush and conveying brush, said scroll to direct the flow of debris from said brushes to said debris hopper, said sweeping brush being mounted on the frame for movement toward said scroll to accommodate wear of the sweeping brush; and a rear wall carried on said-frame behind both said sweeping brush and said conveying brush, said rear wall including a re-circulation flap positioned at the lower end of said rear wall and generally adjacent a rear surface of said sweeping brush, which rear wall, together with said scroll, forms a sweeping compartment.

24. A surface cleaning machine of claim 23, wherein the scroll includes a lower curved portion generally proximate to the sweeping brush and an upper forwardly slanting wall portion.

25. A surface cleaning machine of claim 23, wherein the debris hopper is carried upon a forward portion of the frame.

26. A surface cleaning machine of claim 23, wherein the brushes are mounted on the frame for concurrent movement toward or away from a surface to be swept.

27. A surface cleaning machine of claim 26, wherein the brushes are pivotally mounted on said frame for concurrent movement.

* * * * *

UNITED STATES PATENT AND TRADEMARK OFFICE

CERTIFICATE OF CORRECTION

PATENT NO. : 6,421,870 B1 
DATED : July 23, 2002
INVENTOR(S) : Basham, Michael T. et al.

It is certified that error appears in the above-identified patent and that said Letters Patent is hereby corrected as shown below:

Drawings,
Figure 2, the reference numeral 12 should be replaced with reference numeral 24.

Column 3,
Line 4, delete “any” and insert -- and --;

Column 6,
Line 27, delete “fame” and insert -- frame --;

Signed and Sealed this

Seventh Day of January, 2003

JAMES E. ROGAN
*Director of the United States Patent and Trademark Office*